US005328212A

United States Patent [19]

Kosik, Jr. et al.

[11] Patent Number: 5,328,212

[45] Date of Patent: Jul. 12, 1994

[54] INTERIORLY INSTALLABLE ROOF MOUNT

[76] Inventors: Walter Kosik, Jr., 6 Craven Terr., Derry, N.H. 03038; Ronald E. Sousa, 9 Balckstone Cir., Pelham, N.H. 03076

[21] Appl. No.: 55,677

[22] Filed: Apr. 30, 1993

[51] Int. Cl.[5] ..... E04D 13/00

[52] U.S. Cl. ..... 285/42; 285/43; 285/208; 52/199

[58] Field of Search ..... 52/58, 60, 199, 200; 285/42, 43, 44, 205, 208

[56] References Cited

U.S. PATENT DOCUMENTS

| | | | |
|---|---|---|---|
| 460,424 | 9/1891 | Bidwell | 285/43 |
| 862,415 | 8/1907 | Rohrer | 285/43 |
| 1,282,535 | 10/1918 | Bropson | 285/44 |
| 1,510,265 | 9/1924 | Filkins | 285/43 |
| 2,740,490 | 4/1956 | Mathers | 285/42 |
| 4,433,860 | 2/1984 | Lindquist | 285/42 |
| 4,437,687 | 3/1984 | Wilson | 285/42 |
| 4,512,119 | 4/1985 | Willoughby | 285/43 |
| 4,570,943 | 2/1986 | Houseman et al. | 285/43 |
| 4,833,838 | 5/1989 | Van Dame | 52/200 |
| 5,226,681 | 7/1993 | Smith et al. | 285/203 |

FOREIGN PATENT DOCUMENTS

| | | | |
|---|---|---|---|
| 514185 | 6/1955 | Canada | 285/43 |

*Primary Examiner*—Eric K. Nicholson
*Attorney, Agent, or Firm*—Edward A. Gordon

[57] ABSTRACT

A roof mount for supporting a vertically disposed tubular member on an inclined roof of a building in which the tubular member extends through an opening in the roof. The mounting is disposable on the exterior of the roof wholly from within the building. The mount includes an upper flashing having a peripheral flange with dimensions that are larger than the opening so the upper flashing covers completely the opening. The upper flashing can be slipped through the opening from the inside of the building and fitted on the outside of the roof. A tubular member receiving aperture is disposed within the upper flashing and is arranged to receive the tubular member. Gasketing is provided to seal any spaces between the aperture and the exterior of the tubular member. A lower flange having a central opening to receive the tubular member is disposed within the building and to engage the interior of the roof. Fasteners are sued to fasten the peripheral flange to the lower flange and are tightenable from the interior of the building to clamp the peripheral flange against the roof. The fasteners can include a plurality of bolts attached to the roof engaging side of the peripheral flange and extend into the building through the roof. A nut is attached to each bolt and the bolts are arranged to extend through holes in the lower flange. The nuts engage the lower flange to tighten the roof mount on the roof. A gasketing is disposed between the peripheral flange and the roof and is compressible to prevent the flow of water into the interior of the building from the roof.

10 Claims, 4 Drawing Sheets

INTERIORLY INSTALLABLE ROOF MOUNT

BACKGROUND OF THE INVENTION

1. Field of the Invention

The present invention relates to a support for pipes, vents, flues and other similar tubular members that extend vertically through an inclined roof. More particularly, the present invention relates to a weight-bearing roof mount that can be fitted on the exterior of the roof wholly from inside the building in which it is being installed. The invention especially relates to simplified installation of a vent pipe which does not necessitate climbing ladders, installing roof jacks or using strips of flashing.

It has been found that substantial installation time can be saved through the use of the present roof mount invention for supporting tubular members on inclined roofs. The present roof mount invention provides for all of the installation work to be done from inside the building. Although the roof mount invention is installed from the inside of the building it still can provide waterproof integrity between the roof covering and the interior of the building.

2. Description of the Prior Art

Mounts for vent pipes are well known to the art and the prevention of leakage past these mounts is also well known. Holt U.S. Pat. No. 969,476, discloses a mount for vent pipes which includes a tapered ring that fits within an internally tapered collar. A set of bolts engage the ring and force it into the collar and simultaneously compress a sealing ring to hold a tubular member in place. The device, however, must be mounted from the outside of the roof. Kifer U.S. Pat. No. 3,313,559, discloses a roof flashing with an elastomeric collar in which a flange around the collar can be disposed beneath a course of shingles and the flashing can be nailed in place to hold a tubular member. External mounting of the flashing is required for the disposition of the collar. Similarly with the roof flange disclosed by Gusstaffesen, U.S. Pat. No. 3,677,576, exterior mounting of the flanging is required. The Lane U.S. Pat. No. 897,974, discloses a vent pipe roof mount which is attached to the inclined roof through the use of straps and brackets that are fitted from the outside roof. Jean-Jaques U.S. Pat. No. 4,965,971 discloses a roof mounting for a pipe in which the flange can be mounted at any angle for universal fitting on roofs of many different pitches and still prevent the seepage of water into the building.

SUMMARY OF THE INVENTION

The broad purpose of the present invention is to provide a weight-bearing roof mount for supporting a vertically disposed tubular member on an inclined roof of a building in which the tubular member extends through an opening in the roof that is larger than the tubular member. The weight-bearing mounting is disposed on the exterior of the roof from within the building and does not require the installer to climb on the roof to install it.

The mount includes an upper flashing that has a peripheral flange with dimensions that are larger than the opening that the installer has cut in the roof to install the tubular member. One dimension (length or width) of the opening must be larger than the smallest dimension of the upper flashing. The upper flashing is adapted to be slipped through the opening from the inside of the building by the installer to the outside of the roof. When installed, the upper flashing completely covers the opening. A tubular member receiving aperture is disposed within the upper flashing and a gasket is provided between the exterior of the tubular member and the aperture to prevent leakage.

A lower flange having a central aperture is used to receive the tubular member and secure the upper flashing in place. The lower flange is disposed inside the building and engages the interior of the roof.

The roof mount preferably uses certain geometrical shapes such as ovals, rectangles or squares which can cover a similarly shaped opening cut in the roof. The shapes are such that the upper flashing can be moved from the inside of the building to the outside and then fitted against shingles on the roof to provide a seal. Once through, the upper flashing is set down on the roof where the lower flange can be attached. A gasket is fitted beneath the upper flashing adjacent the shingles. Tightening the lower flange against the upper flashing will compress the gasket and will provide a watertight seal. In some embodiments it is possible to extend the upper portion of the flashing device sufficiently so that the upper portion can be disposed beneath a portion of a course of shingles to provide for a watertight seal whereby water easily runs over the watertight seal.

Accordingly a principle object of the present invention is to provide a weight-bearing roof mounting for a tubular member which can be installed wholly from within the interior of a building while still producing a watertight seal.

The other objects, features and advantages which will become subsequently apparent when considering the details of construction and operation as fully hereinafter described and claimed with reference to the accompanying drawing which form a part hereof.

BRIEF DESCRIPTION OF THE DRAWINGS

For a fuller understanding of the nature and desired objects of the present invention reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
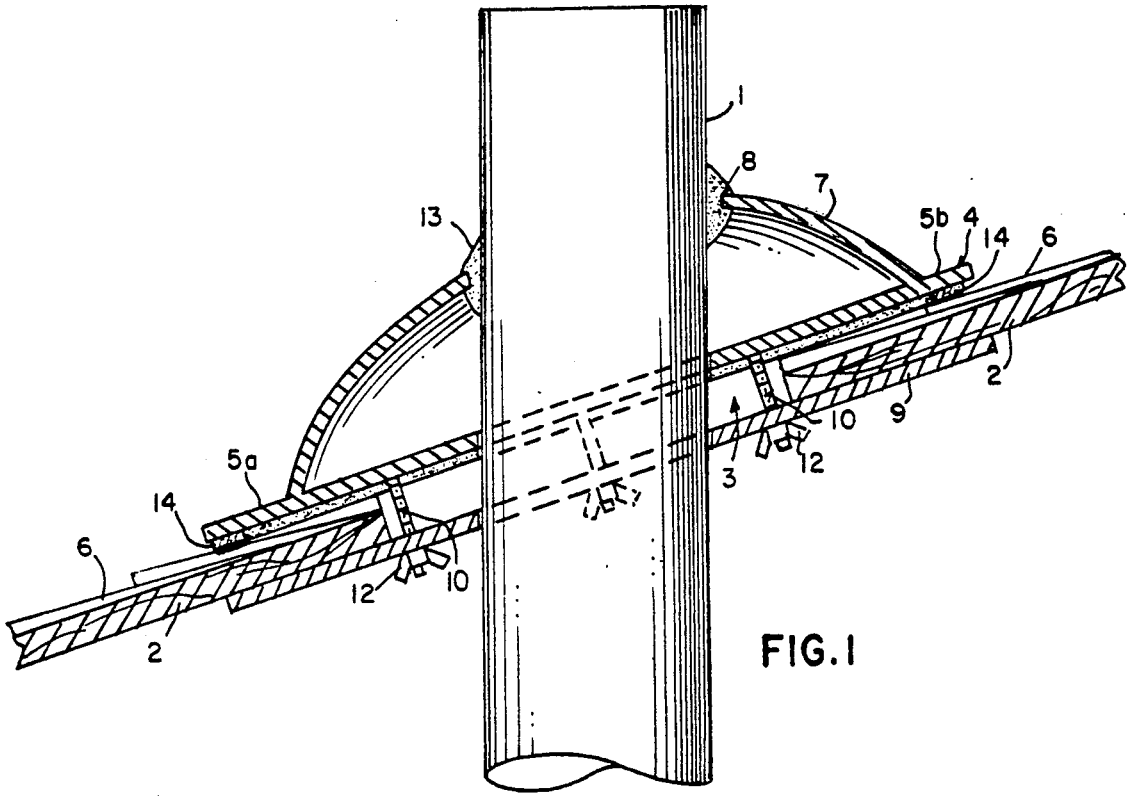
FIG. 1 is a cross-sectional view of part of a tiled roof showing a vent pipe disposed through an opening in the roof and extending through the roof mounting of the present invention which is secured to the roof.

Referring to FIG. 1, the weight-bearing roof mount supports a vertically disposed tubular member 1 generally utilized as a stack or flue vent. The roof mount is disposed on an inclined roof 2 of a building in which the tubular member extends through an opening 3 in the roof. The opening 3 is larger than the tubular member 1 so that it can be easily moved into position. The mounting is disposed on the exterior of the roof 2 and is disposable thereon wholly from within the building.

The roof mount includes an upper flashing device 4 having peripheral flange sections 5*a* and 5*b* with dimensions that are larger than the opening 3. The upper flashing 4 is adapted to be slipped through the opening 3 from the inside of the building. It was found that the upper flashing 4 should have a square, rectangular or oval shape so that it can be passed through the opening 3 from the inside to be seated on the outside of the roof 2. When disposed on the outside of the building the peripheral flange sections 5*a* and 5*b* can be arranged either on top of shingles 6 or the upper portion 5*a* of the flange can be fitted beneath one course of them. In that event water will flow directly over the shingles onto the top of the flange 5*a*.

A raised section 7 is centrally formed within the upper flashing 4. The raised section 7 can be generally spherical or may be tapered with a flat inclined surface starting adjacent the peripheral flange sections 5*a* and 5*b*, as is decoratively appropriate.

A tubular member receiving aperture 8 is formed within the upper flashing 4. Preferably the aperture 8 has a diameter which is substantially the same as the diameter of the tubular member 1. To prevent the leakage of water between the tubular member 1 and the aperture 8, a seal 13 is provided around the aperture. The seal 13 can be a collar which is set around the edges of the aperture 8 or if the upper flashing 4 is made of a self-sealing material the flashing itself can provide the self-sealing.

A lower flange 9 is disposed beneath the roof 2 and is arranged to engage the interior of the roof. In the embodiment shown in FIG. 1, the lower flange 9 has a generally rectangular shape which coincides with the shape of the upper flashing 4. A central opening is provided in the lower flange 9 to receive the tubular member 1. If the outside perimeter of the upper flashing 4 has a generally ovoid shape then the lower flange 9 should have a generally ovoid shape also to provide for easy securing of the roof mount to the roof. A gasket 14 is disposed beneath the peripheral flange sections 5*a* and 5*b* and the exterior of the roof 2.

An array of fasteners is used to secure the roof mount to the building. In the illustrated embodiment the fasteners include bolts 10 that are fixedly attached to the upper flashing 4. Suitable nuts, for example wing nuts 12, are threaded on bolts 10. Washers (not shown) are disposed between the wing nuts 12 and the lower flange 9. Tightening the wing nuts 12 uniformly around the lower flange 9 will squeeze peripheral flange 5 of the upper flashing 4 against the shingles 6 and also squeeze the gasket 14 against the shingles 6 to provide a watertight seal. As has been set out above, the upper end of 5*a* of the upper flashing 4 can be disposed beneath a course of the shingles 6.

Figure 2:
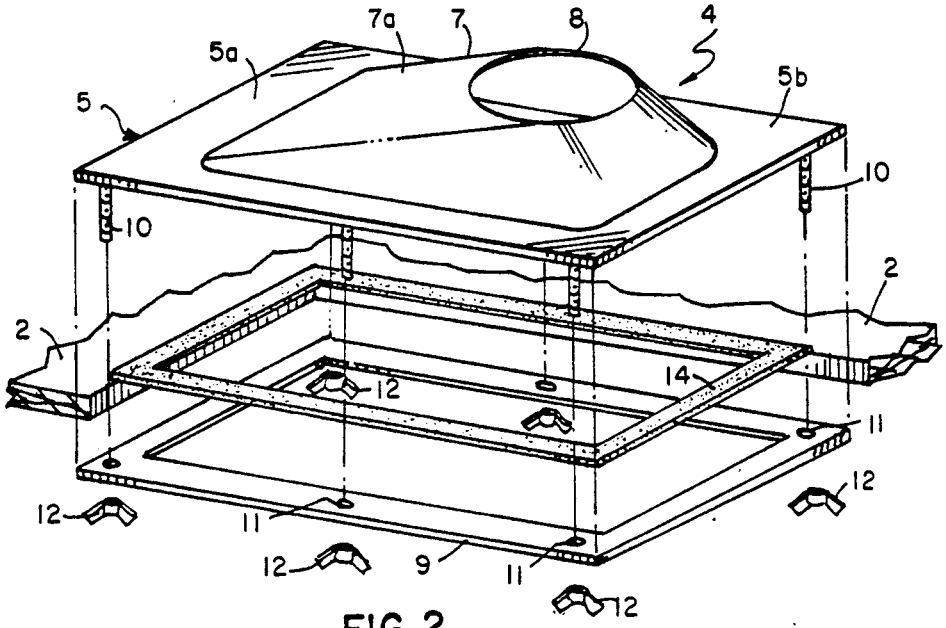
FIG. 2 is an exploded perspective view of a roof mounting according to the present invention.

Turning now to FIG. 2, an exploded view of the roof mount is shown. The roof mount includes the upper flashing 4 with a peripheral flange 5. A raised section 7 is formed on the upper flashing 4 and can be shaped with a planar surface 7*a* that rises from the peripheral flange 5*a* to the aperture 8. This arrangement enables the water to flow around the aperture 8 more easily and avoids leakage and is also decoratively pleasing. The bolts 10 extend from the peripheral flange 5 and are adapted to be fitted into holes 11 in lower flange 9 that are formed to receive them. The gasket 14 is adapted to seat against the roof 2 when the wing nuts 12 are tightened upon the bolts 10.

Figure 3:
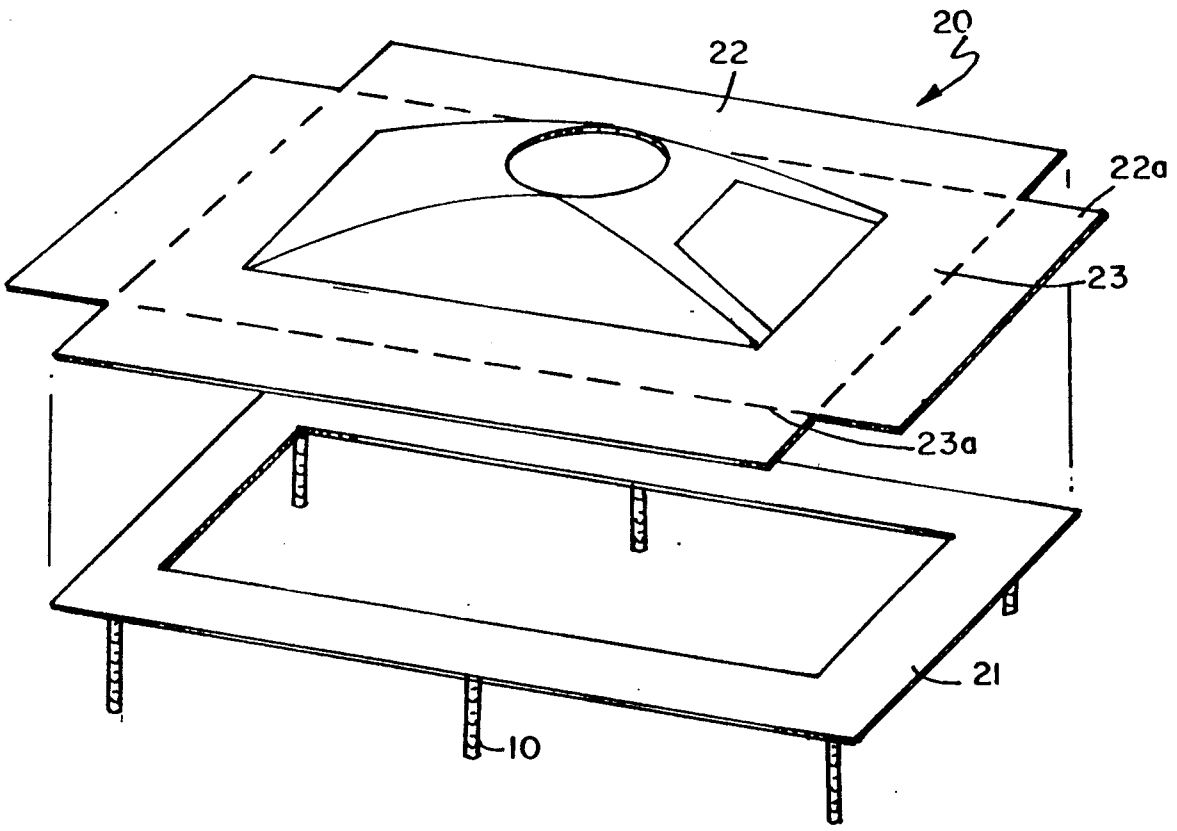
FIG. 3 is an exploded perspective view similar to that shown in FIG. 1, with a soft material disposed over a rigid substrate.

Referring now to FIG. 3, another embodiment of the present invention is disclosed. In this embodiment the upper flashing is formed of two pieces, an exterior sheath 20 and a base support 21. The bolts 10 are attached to the base support 21 and flanges 22 and 22*a* are disposed around the perimeter of the exterior sheath 20. The flanges 22 and 22*a* are bendable on lines 23 and 23*a* and are arranged to be folded over and under. In this way a relatively inexpensive but aesthetically pleasing outer sheath 20 can be used for the peripheral flange while the base support 21 provides structural integrity to the unit. In all other aspects of the use and disposition of the upper flashing is the same as the upper flashing disclosed with reference to FIG. 1. The exterior sheath 20 can be a more simple material such as neoprene rubber or plastic and can be the same.

Figure 4:
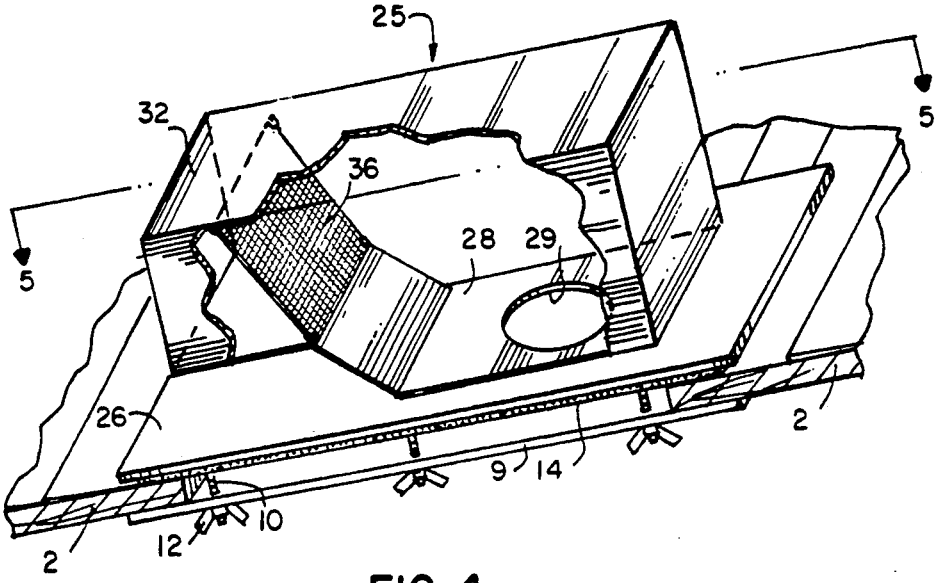
FIG. 4 is a fragmentary perspective view of an alternate embodiment of the roof mounting device of the present invention.
Figure 5:
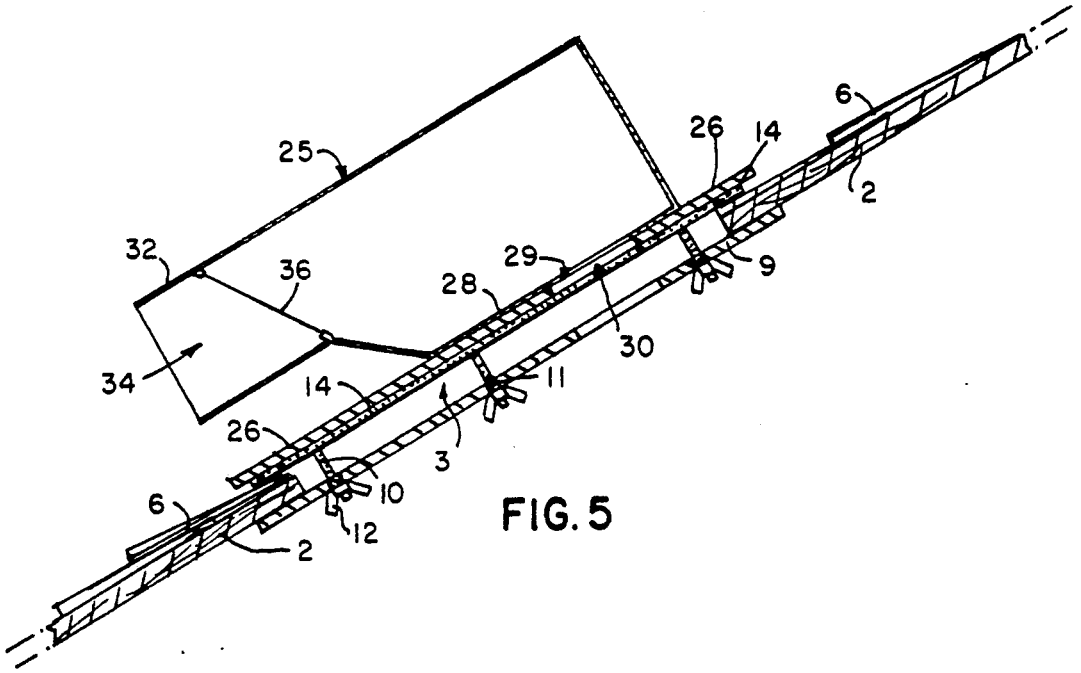
FIG. 5 is a cross-sectional view taken along the line 5—5 of FIG. 4.

Referring now to FIGS. 4 and 5, there is illustrated another embodiment of the present invention. The roof mount includes an upper container section 25 and an upper mounting flashing flange 26 to which the bottom portion 28 of the container 25 is attached. The bottom portion 28 has an opening 29 which meets the opening 30 of the flashing flange 26 which contacts the attic where a pipe or fitting can be attached to provide a selected vent such as an air vent, attic vent, dryer vent, fresh air vent or other air devices which require exhaust or intake of air. In this embodiment the forward end portion 32 of the container 25 is raised up with an open end section 34. Attached within the upper forward end section 32 is a screen device 36 for the openings 29 and 30. As illustrated, the upper forward section 32 of the container 25 faces the downward side of the roof pitch 2. In all other respects the securing of the container 25 is similar to that of FIGS. 1 and 2.

Figure 6:
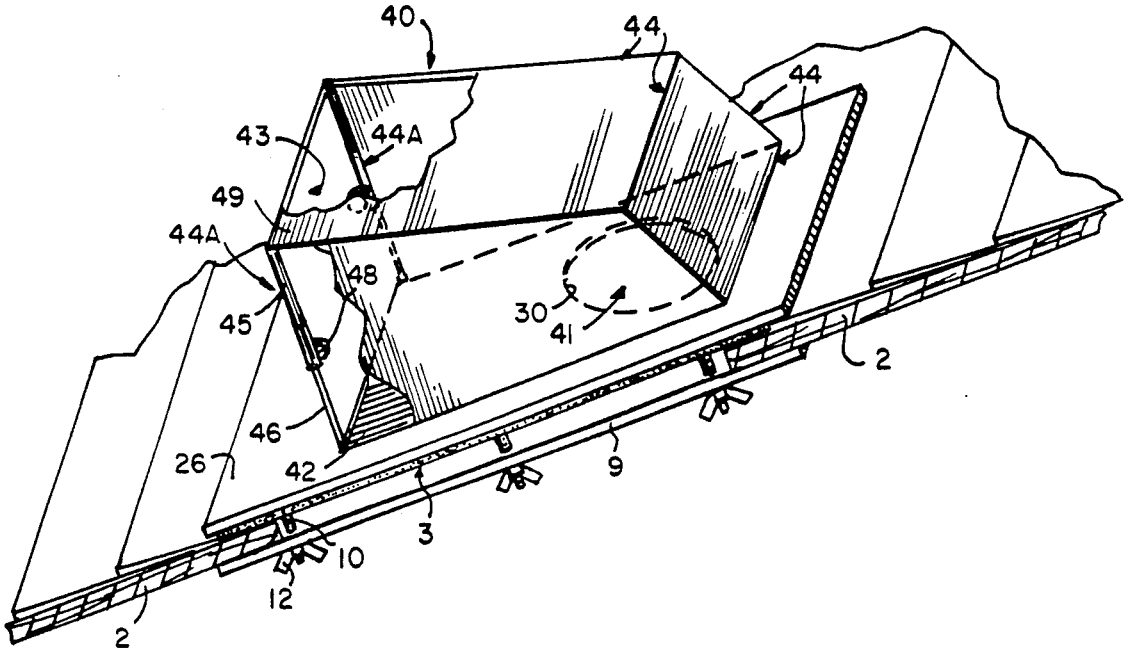
FIG. 6 is a fragmentary perspective view of a alternate embodiment of the roof mounting device of the present invention.

Referring now to FIG. 6, there is illustrated another embodiment of the present invention. The roof mount is similar to that of FIG. 4 except that it contains an alternate embodiment of an upper cover device 40 which is preferably formed of a flexible liquid resistant material such as rubber. The cover device 40 with an opening 41 in the bottom portion 42 which is attached to the flashing flange 26 and contacts the opening 30 of the flashing flange 26. The cover device 40 has a forward open section 43 which permits exhaust or intake of air. The cover device 40 includes inner liner member 44 which extends about the inner edge surfaces of the cover device 40. The vertical forward liner members 44A are formed of two vertical telescoping members 45 and 46 which are adjustable up and down by the suitable bolt means 48. With respect to the forward liner sections 44A the liquid resistant cover material 49 is attached only to the outer side of the upper section 45. In this matter, the higher forward portion forming the open section 43 can be lower to permit the cover device to be easily inserted through the opening 3 when attached to the flashing flange 26. After the flashing flange 26 is attached to the roof section, the operator's hand can be inserted through the opening 41 and secure the forward portion of the cover device 40 in a selected upper position.

While nuts and bolts are the preferred mechanisms for attachment of the lower flange 9 to the upper flashing 4 other mechanisms can involve a U-channel that is attached to the underside of the upper flashing. The U-channel is open on the bottom to accept a locking screw and a securing tab A J-channel is attached to the top flashing flange and will accept a lower securing hooking screw. With regard to the gasket it can be made of conventional gasket material such as resilient rubber or neoprene and it can be attached or molded to the bottom of the upper flashing flange or it can be applied at the time of insulation. On roofs with irregular surfaces a small amount of bonding adhesive or caulking can be applied to either side of the gasket or the roof to secure attachment.

While the invention has been described with respect to preferred embodiments, it will be apparent to those skilled in the art that changes and modifications may be made without departing from the scope of the invention herein involved in its broader aspects. Accordingly, it is intended that all matter contained in the above description or shown in the accompanying drawing shall be interpreted as illustrative and not in limiting sense.

What is claimed is:

1. A weight-bearing roof mount for supporting a vertically disposed tubular member on an inclined roof of a building having courses of shingles thereon and in which the tubular member extends roof through an opening in the roof that is larger than the tubular member, said mounting being disposable on the exterior of the roof wholly from within the building, said roof mount comprising:

an upper flashing having a peripheral flange with dimensions larger than said opening whereby said upper flashing covers completely said opening, said upper flashing being adapted to be slipped through said opening from the inside of said building to be fitted on the outside of said roof, said upper flashing having a roof-engaging side that engages said shingles and an exterior side, said upper flashing being of sufficient length to enable it to be disposed beneath one of the courses of shingles above said opening;

a tubular member receiving aperture disposed within said upper flashing, said aperture being arranged to receive said tubular member;

means to seal any spaces between said aperture and the exterior of said tubular member;

a lower flange means having a central opening to receive said tubular member, said lower flange means being arranged to be disposed within said building and to engage the interior of said roof;

fastener means to fasten said peripheral flange to said lower flange said fastener means being tightenable from the interior of said building whereby to clamp said peripheral flange against said roof;

gasketing means disposed between said peripheral flange and said shingles and being compressible between said shingles and said peripheral flange whereby to prevent the flow of fluids into the interior of said building from said roof.

2. The roof mount according to claim 1 wherein the fastener means includes a plurality of bolts attached to the roof engaging side of said peripheral flange and arranged to extend into said building through said roof; a nut attached to each of said bolts; said bolts being arranged to extend through holes in said lower flange means, said nuts being arranged to engage said lower flange means to tighten said roof mount on said roof.

3. The roof mount according to claim 1 wherein said upper flashing has a raised section disposed centrally of said peripheral flange, said aperture being disposed centrally of said raised section whereby said aperture can receive said tubular member.

4. The roof mount according to claim 2 wherein the lower flange means is formed of an array of fastener means, each of the fastener means being of sufficient length to engage the periphery of said opening and to receive said bolts in said holes.

5. The roof mount according to claim 1 wherein the lower flange means is a plate having the same general shape as said peripheral flange, said plate having holes arranged therein to receive said bolts.

6. A weight-bearing roof mount for supporting an upper air venting container member in contact with a vertically disposed air vent device on an inclined roof of a building in which the air vent device extends through an opening in the roof that is larger than the air vent device, said mounting being disposable on the exterior of the roof wholly from within the building, said roof mount comprising:

an upper flashing having a peripheral flange with dimensions larger than said opening whereby said upper flashing covers completely said opening, said upper flashing being adapted to be slipped through said opening from the inside of said building to be fitted on the outside of said roof, said upper flashing having a roof-engaging side and an exterior side;

an air vent device receiving aperture disposed within said upper flashing, said aperture being arranged to receive said air vent device;

means to seal any spaces between said aperture and the exterior of said air vent member;

an upper air venting container member attached to the upper outer surface of the peripheral flange; said air venting container member having a rearward portion and an upper forward portion; said rearward portion having a bottom opening which contacts the roof air vent device; said upper forward portion having a forward open end section and a screen device positioned within the forward portion between the forward open end section and the rearward air vent device;

a lower flange means having a central opening to receive said air vent member, said lower flange means being arranged to be disposed within said building and to engage the interior of said roof;

fastener means to fasten said peripheral flange to said lower flange, said fastener means being tightenable from the interior of said building whereby to clamp said peripheral flange against said roof; and a gasketing means disposed between said peripheral flange and said roof and being compressible between said roof and said peripheral flange whereby to prevent the flow of fluids into the interior of said building from said roof.

7. The roof mount according to claim 6 wherein the fastener means includes a plurality of bolts attached to the roof engaging side of said peripheral flange and arranged to extend into said building through said roof; a nut attached to each of said bolts, said bolts being arranged to extend through holes in said lower flange, said nuts being arranged to engage said lower flange to tighten said roof mount on said roof.

8. The roof mount according to claim 7 wherein the lower flange means is formed of an array of fastener means, each of the fastener means being of sufficient length to engage the periphery of said opening and to receive said bolts in said holes.

9. The roof mount according to claim 7 wherein the lower flange means is a plate having the same general shape as said peripheral flange, said plate having holes arranged therein to receive said bolts.

10. A weight-bearing roof mount for supporting an upper air venting container member in contact with a vertically disposed air vent device on an inclined roof of a building in which the air vent device extends through an opening in the roof that is larger than the air vent device, said mounting being disposable on the exterior of the roof wholly from within the building, said roof mount comprising:

an upper flashing having a peripheral flange with dimensions larger than said opening whereby said upper flashing covers completely said opening, said upper flashing being adapted to be slipped through said opening from the inside of said building to be fitted on the outside of said roof, said upper flashing having a roof-engaging side and an exterior side;

an air vent device receiving aperture disposed within said upper flashing, said aperture being arranged to receive said air vent device;

means to seal any spaces between said aperture and the exterior of said air vent member;

an upper air venting container member attached to the upper outer surface of the peripheral flange; said air venting container member being formed of a flexible liquid resistant material and having a rearward portion and an open forward portion; said rearward portion having a bottom opening which contacts the roof air vent device; said open forward portion having upper and lower vertical adjustable side members with the flexible liquid resistant material attached on each side to the upper vertical adjustable side members;

a lower flange means having a central opening to receive said air vent member, said lower flange means being arranged to be disposed within said building and to engage the interior of said roof;

fastener means to fasten said peripheral flange to said lower flange, said fastener means being tightenable from the interior of said building whereby to clamp said peripheral flange against said roof; and a gasketing means disposed between said peripheral flange and said roof and being compressible between said roof and said peripheral flange whereby to prevent the flow of fluids into the interior of said building from said roof.

* * * * *